US008272405B2

(12) United States Patent
Mun

(10) Patent No.: US 8,272,405 B2
(45) Date of Patent: Sep. 25, 2012

(54) FITTING TO PLUG AN EXPOSED DEEP SEA PIPE

(76) Inventor: Kam Chong Mun, Rosemead, CA (US)

( * ) Notice: Subject to any disclaimer, the term of this patent is extended or adjusted under 35 U.S.C. 154(b) by 254 days.

(21) Appl. No.: 12/803,939

(22) Filed: Jul. 9, 2010

(65) Prior Publication Data

US 2012/0006531 A1 Jan. 12, 2012

(51) Int. Cl.
*F16L 55/11* (2006.01)

(52) U.S. Cl. ..... 138/89; 138/90

(58) Field of Classification Search ..... 138/89, 138/90; 166/192
See application file for complete search history.

(56) References Cited

U.S. PATENT DOCUMENTS

| | | | | | |
|---|---|---|---|---|---|
| 528,459 | A | * | 10/1894 | Believeau | 137/242 |
| 1,554,856 | A | * | 9/1925 | Kennedy | 138/90 |
| 2,062,519 | A | * | 12/1936 | Ljungberg | 138/90 |
| 2,374,947 | A | * | 5/1945 | Nicholson | 138/90 |
| 2,512,169 | A | * | 6/1950 | Nachtigal | 138/89 |
| 2,810,401 | A | * | 10/1957 | Stansbury | 138/89 |
| 3,006,680 | A | * | 10/1961 | Gregory | 294/93 |
| 4,073,836 | A | | 2/1978 | Harrison | |
| 4,248,271 | A | * | 2/1981 | Burgess | 138/89 |
| 4,756,338 | A | | 7/1988 | Guyatt | |
| 5,307,841 | A | * | 5/1994 | Condon | 138/90 |
| 5,894,864 | A | | 4/1999 | Rich | |
| 6,029,709 | A | * | 2/2000 | Burgess | 138/89 |
| 6,296,006 | B1 | | 10/2001 | Wegner | |
| 6,334,465 | B2 | | 1/2002 | Boulet D'Auria | |
| 6,588,070 | B2 | | 7/2003 | Tran | |
| 6,901,967 | B1 | | 6/2005 | Kuenzer | |
| 8,042,576 | B2 | * | 10/2011 | Peterson et al. | 138/90 |

* cited by examiner

*Primary Examiner* — Patrick F Brinson

(57) ABSTRACT

The present invention comprises a fitting that is inserted into an exposed pipe in a deep sea by a submersible robot. The robot rotates a bolt which in turn rotates a gear wheel. When said gear wheel is rotated, it will rotate two diametrically opposite drill bits. A spring is placed between the drill bits so that said spring pushes the drill bits toward the inside bore of said exposed pipe. The two diametrically opposite drill bits drill and attach themselves to the inside bore of said exposed pipe.

After the drill bits have been attached to the inside bore of said exposed pipe, said robot shall turn two bolts (hereinafter called A and B) which will in turn push a plug towards the exposed pipe. The plug is made of soft but durable material. When the robot tightens said two bolts A and B, the plug will stop any leakage of oil from the exposed pipe.

In the preferred embodiment, said plug is made of an elastomer, such as rubber or neoprene.

12 Claims, 2 Drawing Sheets

FITTING TO PLUG AN EXPOSED DEEP SEA PIPE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to a fitting to plug an exposed pipe in a deep sea from leaking oil. As an example, this is most applicable to stop the exposed pipe of the Deepwater Horizon oil rig that had a blowout and resulted in said pipe gushing oil into the Gulf of Mexico and the environment.

2. Prior Art

Presently, containment caps and containment domes have been used to contain the oil that is leaking from the exposed pipe. The above said methods capture only a fraction of the oil and does not totally stop the oil from leaking.

Other methods are shown in:

| | |
|---|---|
| U.S. Pat. No. 4,073,836, | U.S. Pat. No. 4,756,338 |
| U.S. Pat. No. 5,894,864, | U.S. Pat. No. 6,296,006 B1. |
| U.S. Pat. No. 6,334,465 B2 | U.S. Pat. No. 6,588,070 B2 & |
| U.S. Pat. No. 6,901,967 B1 . | |

U.S. Pat. No. 4,073,836 uses a sealant to seal leaks at flanged connections of pipes.

U.S. Pat. No. 4,756,338 uses a gasket, a sleeve and a pipe repair assembly to stop the leak in a pipe that is carrying fluid under pressure.

U.S. Pat. No. 5,894,864 uses a patch or other material to wrap around the leaking pipe followed by wrapping with a fabric or an elastic band.

U.S. Pat. No. 6,296,006 B1 uses barrier tape, an inflatable seal and a reinforcing layer to seal the leak in porcelain pipes used in high voltage electrical devices.

U.S. Pat. No. 6,334,465 B2 uses an elastomer sheet such as rubber or neoprene, and a clamping mechanism to press onto the elastomer sheet to stop the leak in a pipe.

U.S. Pat. No. 6,588,070 B2 uses a repair clamp which is a flexible, circular metal band lined with a gasket to stop the leak in a pipe.

U.S. Pat. No. 6,901,967 B1 uses a top and bottom half pipe repair fitting over a leaking pipe and welding them together.

All the above said inventions cannot be used to stop oil gushing from an exposed pipe in a deep sea.

SUMMARY OF THE INVENTION

The present invention comprises a fitting that is inserted into an exposed pipe in a deep sea by a submersible robot. The robot rotates a bolt which in turn rotates a gear wheel. When said gear wheel is rotated, it will rotate two diametrically opposite drill bits. A spring is placed between the drill bits so that said spring pushes the drill bits toward the inside bore of said exposed pipe. The two diametrically opposite drill bits drill and attach themselves to the inside bore of said exposed pipe.

After the drill bits have been attached to the inside bore of said exposed pipe, said robot shall turn two bolts (hereinafter called A and B) which will in turn push a plug towards the exposed pipe. The plug is made of soft but durable material. When the robots tighten said two bolts A and B, the plug will stop any leakage of oil from the exposed pipe.

In the preferred embodiment, said plug is made of an elastomer, such as rubber or neoprene.

As the two bolts A and B are turned, a metal plate is used to equalize the pressure that is exerted onto the plug. This metal plate is used in the preferred embodiment, but it is not a necessity.

DETAILED DESCRIPTION OF THE PREFERRED EMBODIMENTS

Figure 1:
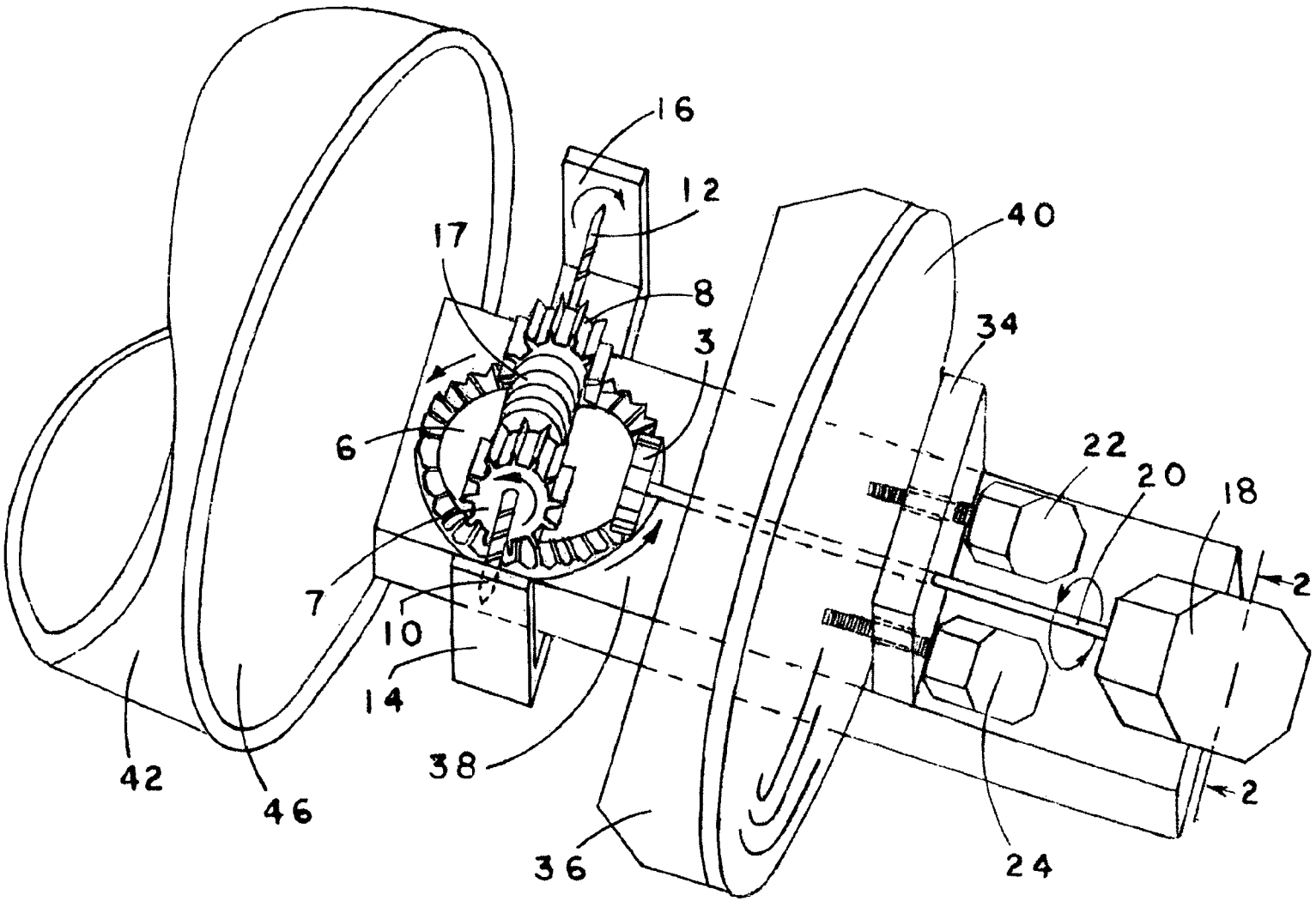
FIG. 1 is a perspective view of one embodiment of the invention. It shows the invention that is to be inserted into the exposed pipe that is leaking oil.

FIG. 1 shows a perspective view of one embodiment of the invention. A submersible robot inserts the invention into the opening 46 of the exposed pipe 42. The robot pushes the invention into the opening 46 of the exposed pipe 42 such that the plug 36 pushes lightly against the exposed pipe 42.

Referring to FIG. 1, the invention has a drive shaft 20 that has a bolt head 18 at one end and a pinion gear 3 at the other end. The preferred embodiment of the invention has a drive shaft 20 with a bolt head 18. Said drive shaft 20 is not limited to having a bolt head at one end. In other embodiments, said drive shaft 20 may have a screw head at one end. Or it may have a head made to fit an Allen key.

Said pinion gear 3 engages with gear wheel 6 such that as the pinion gear is rotated by rotating bolt head 18, gears 7 and 8 also rotate. As the bolt head 18 rotates in a counter clockwise direction, the gears 7 and 8 both rotate in a clockwise direction. A spring 17 is inserted into the space in between the gears 7 and 8 so that it pushes the gears 7 and 8 and hence the drill bits 10 and 12 against members 14 and 16. In the preferred embodiment, members 14 and 16 are made of soft material such as soft plastic or wood or chipboard.

As the robot further turns the bolt head 18 in a counter clockwise direction, the drill bits 10 and 12 are turned in a clockwise direction and proceed to drill two holes into members 14 and 16. The speed at which the robot turns bolt head 18 is typically, but not limited to, around 3,000 revolutions per minute. The spring 17 pushes the drill bits 10 and 12 against the two members 14 and 16. Eventually, the drill bits 10 and 12 will drill through the two members 14 and 16 and into the inside bore of the exposed pipe 42.

The drill bits 10 and 12 will stop drilling into the inside bore of the exposed pipe 42 when the gears 7 and 8 pushes against the two members 14 and 16 and is thus constrained.

In the preferred embodiment, the length of the gears 7 and 8 should be longer than the distance that the drill bits 10 and 12 drill into the inside bore of the exposed pipe 42. The distance that the drill bits 10 and 12 drill into the inside bore of the exposed pipe need not be more than its thickness.

When the drill bits 10 and 12 are attached firmly into the inside bore of the exposed pipe 42, the plug 36 is pushed into the opening 46 of the exposed pipe 42 and thus plugging it up. The robot take turns to rotate bolts 22 and 24 so as to push the plug 36 into the opening 46 of the exposed pipe.

Referring to FIG. 1, member 34 is fixed to base plate 38 and has two holes with internal threads. In the preferred embodiment, when the bolts 22 and 24 are rotated, they push the metal plate 40 and hence the plug 36 against the opening 46. The metal plate 40 is used to equalize the pressure that is exerted by the two bolts 22 and 24 onto the plug 36. This metal plate 40 is used in the preferred embodiment, but it is not a necessity.

By tightening the bolts 22 and 24, the robot can push the plug 36 tightly against the opening 46 of exposed pipe 42. This plugs the opening 46 of exposed pipe 42 and thus seal the pipe from leaking oil.

Figure 2:
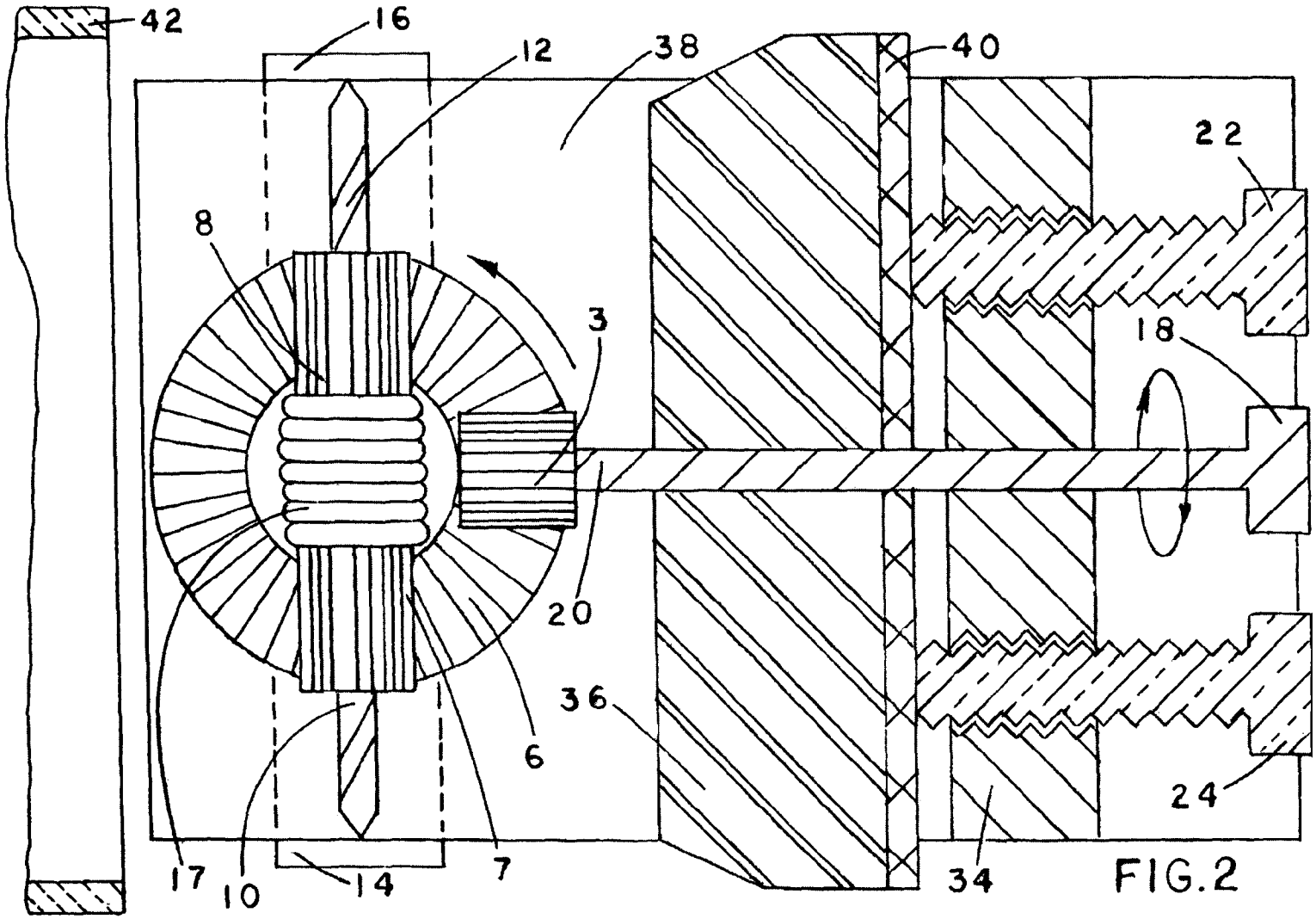
FIG. 2 is a cross sectional view of one embodiment of the invention taken from the cut 2-2 as shown in FIG. 1.

Referring to FIG. 2, in the preferred embodiment, the plug 36 is slightly tapered and is minimally larger than the inside diameter of the exposed pipe 42. The plug 36, should be made of an elastomer, such as rubber or neoprene.

I claim:

1. A fitting to plug an exposed deep sea pipe comprising:

a. a drive shaft that has a bolt head at one end and a pinion gear at the other end;

b. a gear wheel connected to a base plate;

c. said pinion gear engages with said gear wheel such that as said bolt head is rotated, said gear wheel rotates two diametrically opposite gears;

d. said two diametrically opposite gears are each connected to a drill bit at its other end;

e. a spring in between the two said diametrically opposite gears;

f. said bolt head is rotated so that said drill bits drill into the inside bore of an exposed pipe;

g. said drive shaft passes through a plug;

h. means to push said plug along said drive shaft to plug said exposed pipe.

2. The plug of claim 1 wherein said means to push said plug along said drive shaft comprises rotating a threaded bolt in a member fixed to said base plate.

3. The plug of claim 1 wherein said plug is tapered.

4. The plug of claim 1 wherein said plug is made of an elastomer.

5. The plug of claim 1 wherein a rigid plate is placed next to said plug in a position away from said exposed pipe.

6. The drive shaft of claim 1 wherein said drive shaft has a screw head at one end.

7. The drive shaft of claim 1 wherein said drive shaft has a head made to fit an Allen key.

8. A fitting to plug an exposed deep sea pipe comprising:

a. a gear wheel;

b. a base plate connected to said gear wheel;

c. two diametrically opposite gears that engages the teeth of said gear wheel;

d. said two diametrically opposite gears are each connected to a drill bit at its other end;

e. a spring in between two said diametrically opposite gears;

f. a plug connected to said base plate;

g. means to rotate said gear wheel so that said drill bits drill into the inside bore of an exposed pipe;

h. means to push said plug to plug said exposed pipe.

9. The plug of claim 8 wherein said means to push said plug to plug said exposed pipe comprises rotating a threaded bolt in a member fixed to said base plate.

10. The plug of claim 8 wherein said plug is tapered.

11. The plug of claim 8 wherein said plug is made of an elastomer.

12. The plug of claim 8 wherein a rigid plate is placed next to said plug in a position away from said exposed pipe.

* * * * *